US005220337A

United States Patent [19]

Ajioka

[11] Patent Number: 5,220,337

[45] Date of Patent: Jun. 15, 1993

[54] NOTCHED NESTED CUP MULTI-FREQUENCY BAND ANTENNA

[75] Inventor: James S. Ajioka, Fullerton, Calif.

[73] Assignee: Hughes Aircraft Company, Los Angeles, Calif.

[21] Appl. No.: 705,462

[22] Filed: May 24, 1991

[51] Int. Cl.[5] ..... H01Q 13/10

[52] U.S. Cl. ..... 343/770; 343/789

[58] Field of Search ..... 343/767, 770, 771, 789

[56] References Cited

U.S. PATENT DOCUMENTS

| | | | |
|---|---|---|---|
| 2,600,179 | 6/1952 | Alford | 343/767 |
| 2,803,008 | 8/1957 | Lindenblad | 343/770 |
| 2,976,534 | 3/1961 | Kampinsky | 343/820 |
| 4,129,871 | 12/1978 | Johns | 343/771 |
| 4,763,130 | 8/1988 | Weinstein | 343/770 |

*Primary Examiner*—Michael C. Wimer

*Assistant Examiner*—Tan Ho

*Attorney, Agent, or Firm*—Wanda K. Denson-Low

[57] ABSTRACT

A cavity with a plurality of notches formed in the edge of the open end. Each notch is fed to establish a notch-type antenna. Notches at 90 angles from each other are formed for a monopulse application. A coaxial feed line is used where the outer conductor is connected at one side of the notch and the inner conductor at the other side. The sizes of the cavity and notches are selected to radiate energy of a selected frequency bandwidth. Additional cavities of different sizes for radiating different selected frequencies are nested concentrically together to form a multifrequency antenna array with a common phase center. Each cavity has a plurality of notches and each cavity may be rotated in relation to the adjacent cavity to misalign the notches between the two cavities and thereby increase isolation between frequency bands.

15 Claims, 3 Drawing Sheets

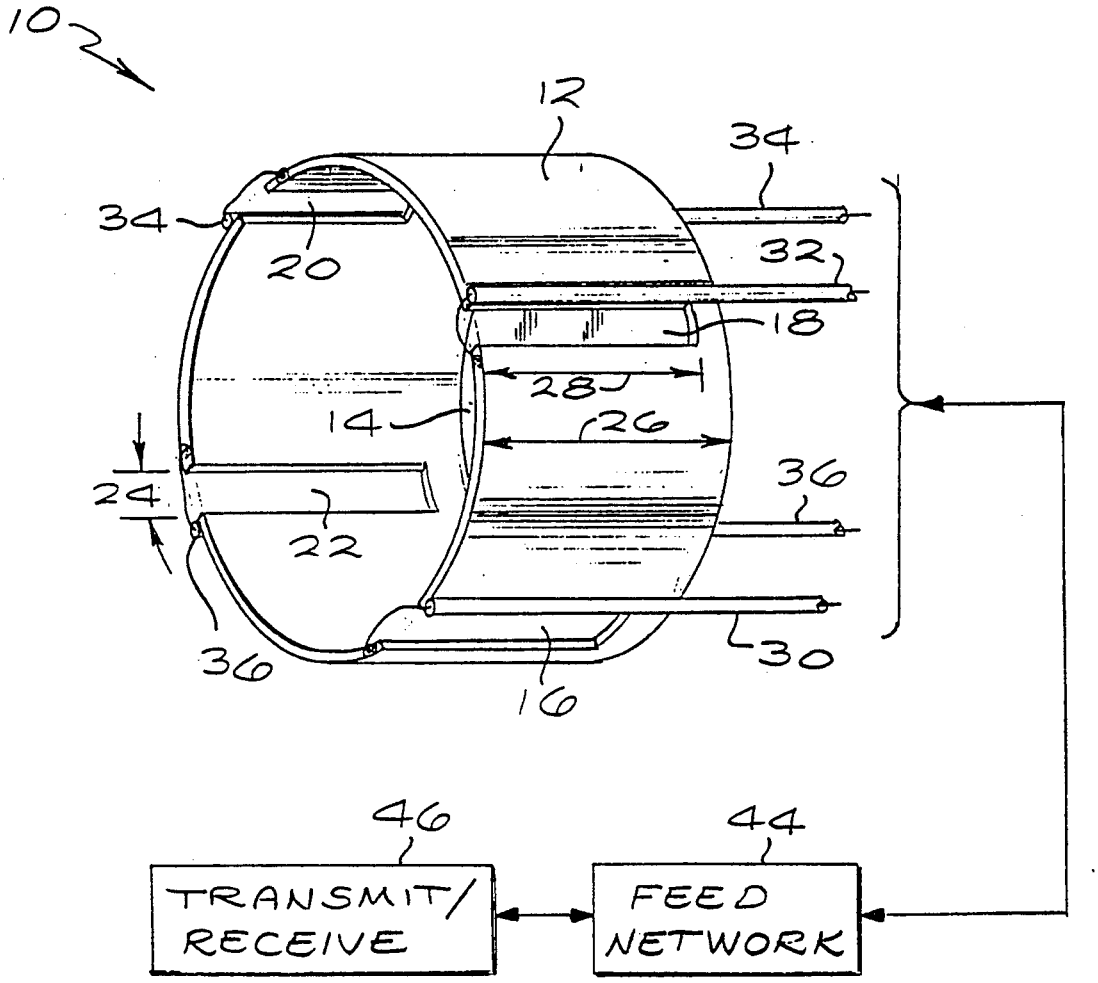
FIG. 1
FIG. 2
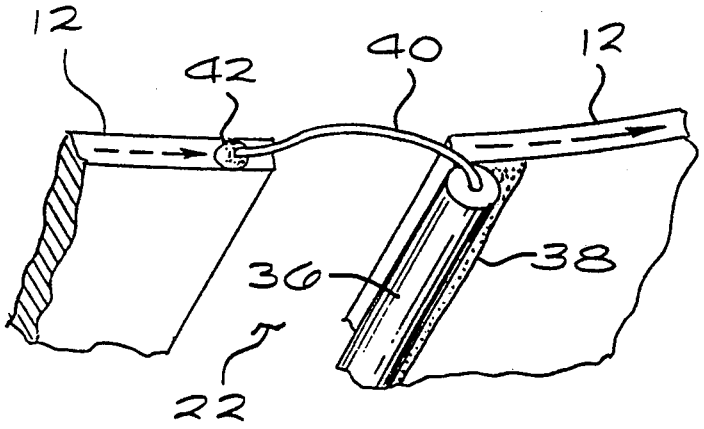

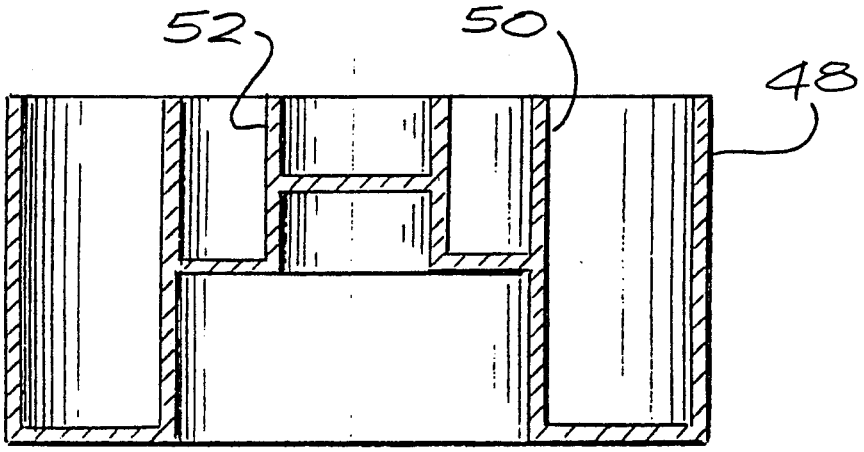
FIG. 5
FIG. 6
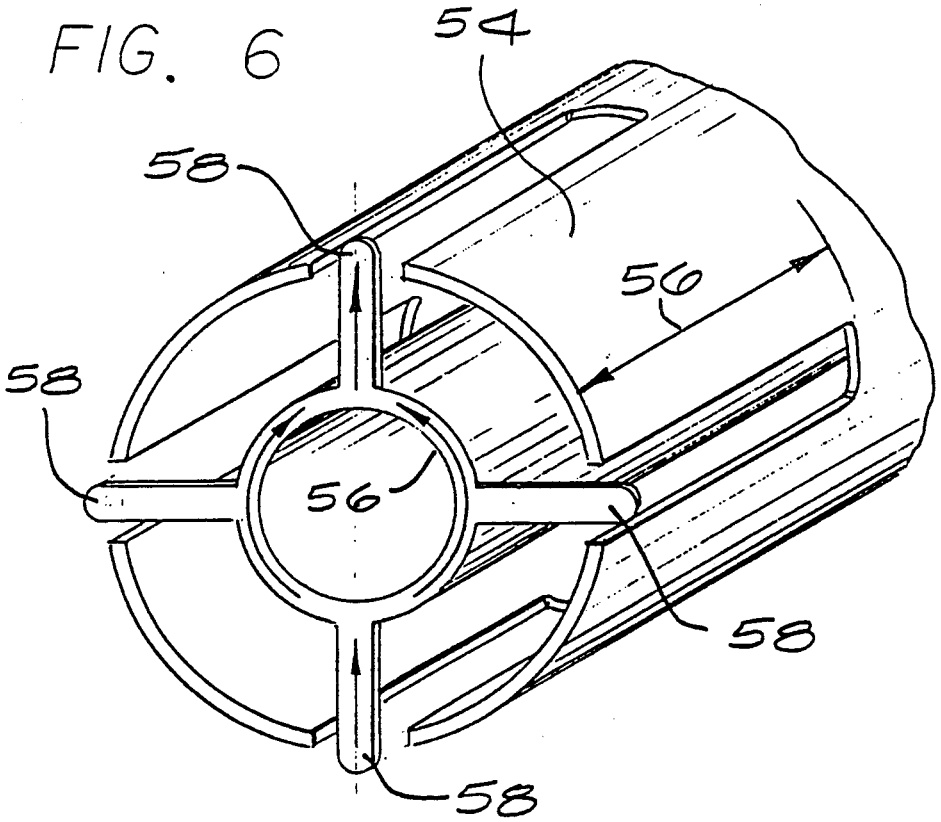

NOTCHED NESTED CUP MULTI-FREQUENCY BAND ANTENNA

BACKGROUND

The invention is related generally to antennas, and more particularly, to multi-frequency band antennas capable of dual polarization operation.

Compact monopulse antennas are useful in many applications and a dual polarization antenna usable for monopulse operation is also desirable for many applications. An ideal antenna with relatively wide angular coverage, such as a 3 dB beamwidth at 90°, circularly polarized with rotationally symmetric radiation patterns, could, in principle, consist of a circular current loop with current distribution $e^{\pm jm\phi}$, where $\phi$ is the azimuthal angle and m is an integer. The m=1 mode radiates a circularly polarized wave with maximum normal to the plane of the loop and has a rotationally symmetric radiation pattern. The m=0 and m=even modes have radiation patterns with a null on the axis normal to the loop. The m=2 mode is most often used to generate monopulse "difference" patterns.

Isolated current loop type antennas have bi-directional radiation; i.e., they radiate equally in both hemispheres on the axis normal to the plane of the loop. This radiation pattern behind the antenna is undesirable in many applications, including monopulse applications. One commonly used method for eliminating this rear pattern is to couple an absorbing cavity to the back of the antenna which then absorbs energy in the rear pattern. However, such cavities can result in a significant increase in cost and weight. Another technique is to use a power absorbing ground plane to dissipate the rear pattern. While these techniques may achieve elimination of the rear pattern, they result in the loss of approximately 3 dB of antenna gain. Additionally, lossy cavities are in many cases difficult to design and are a major contributor to the cost of the antenna.

Another technique used for rear pattern elimination is the coupling of a metallic ground plane to the antenna which is placed approximately one-quarter wavelength from the plane of the antenna current loop. This technique can result in a unidirectional radiation pattern; however, the ground plane spacing is typically accurate for only one frequency band and results in reduced performance at other frequency bands.

Conical spiral antennas have been designed which result in unidirectional patterns; however, the phase center of radiation is typically not fixed but varies with frequency. Hence this design is not an efficient feed for reflectors or lenses and will usually occupy a much larger volume because of the length of the sharp cone necessary for unidirectional radiation.

"Tightly wound" archimedes or log periodic (equiangular) spiral antennas can approximate an ideal current loop. Spirals of single and multiple arms exist. The active radiating region is equivalent to a current loop of an integral number of wavelengths in circumference. The wavelength referred to is the wavelength of the wave travelling along the spiral conductor and it is usually slightly less than the free space wavelength. Multi-arm spirals are used for monopulse operation because the "sum" and "difference" modes can be controlled by the feed network to the multiple arms.

One disadvantage of spiral antennas is the requirement for a lossy ground plane or rear absorbing cavity which results in a 3 dB reduction of antenna gain. Additionally, prior spiral antennas have only one sense of circular polarization which is determined by the sense of the spiral winding. Attempts have been made to feed the spiral from the outside to achieve circular polarization of the opposite sense. This has only been partially successful because the active region for these modes is in the outer regions of the spiral and feeding it in this region results in undesirable higher order modes.

A sinuous antenna has been disclosed which claims to be capable of radiating both senses of circular polarization equally well, see U.S. Pat. No. 4,658,262 to DuHamel. The antenna may also be able to radiate orthogonal linear polarizations. However, the antenna has a lossy cavity back and therefore loses approximately 3 dB of its gain.

Hence, those concerned with the development and use of antennas have long recognized the need for a dual polarization, unidirectional antenna which does not sacrifice 3 dB of antenna gain in a rear pattern yet is capable of a monopulse operation. The present invention fulfills these needs.

SUMMARY OF THE INVENTION

In accordance with the principles of the invention, an antenna comprises a cavity having a plurality of notches formed in the edge of the open end to provide a plurality of notch antennas. The notches are separately energized and function as individual notch antennas. In one case, a cylindrical cavity is formed with four notches placed at 90° intervals.

Each notch is fed so that currents reside in the rim of the open end of the cavity thereby forming a unidirectional antenna. In one embodiment, a separate coaxial feed is used for each notch with one conductor connected to one side of the notch and the other connected to the opposite side of the notch. The feeds are used to properly phase the notches to form the current loop. The size of the circumference of the cavity is based on the frequency band to be radiated, as are the notch width and depth dimensions. The notch spacing and locations are selected based on the application of the antenna.

An array of nested, concentrically located notched cavities is provided in one embodiment. Each cavity has dimensions selected to efficiently radiate energy of a particular different frequency band thus resulting in a plurality of different sized cavities and a multi-frequency band antenna. The plurality of cavity elements are nested together so that they are concentrically located and all phase centers are on a common aperture plane. This results in a multiple frequency, dualpolarization antenna having a phase center which is invariant with frequency change. Cavities may be rotated in relation to adjacent cavities so that the notches are misaligned.

In another embodiment, parasitically excited dipole elements may be positioned in front of the notches to aid in pattern adjustment and impedance matching.

Other aspects and advantages of the invention will become apparent from the following detailed description and accompanying drawings, illustrating by way of example the features of the invention.

BRIEF DESCRIPTION OF THE DRAWINGS

FIG. 1 is a perspective view of a cavity antenna element in accordance with the principles of the invention having four feeds and four notches;

FIG. 2 is a view of a connection of a coaxial feed to a notch in the antenna element of FIG. 1;

FIG. 5 is a side, cross-sectional view of the array shown in FIG. 3 showing one mechanical connection technique; and FIG. 6 is a further embodiment of an antenna in accordance with the principles of the invention showing the use of parasitically excited dipole stubs for pattern adjustment.

DETAILED DESCRIPTION OF THE PREFERRED EMBODIMENTS

Figure 3:
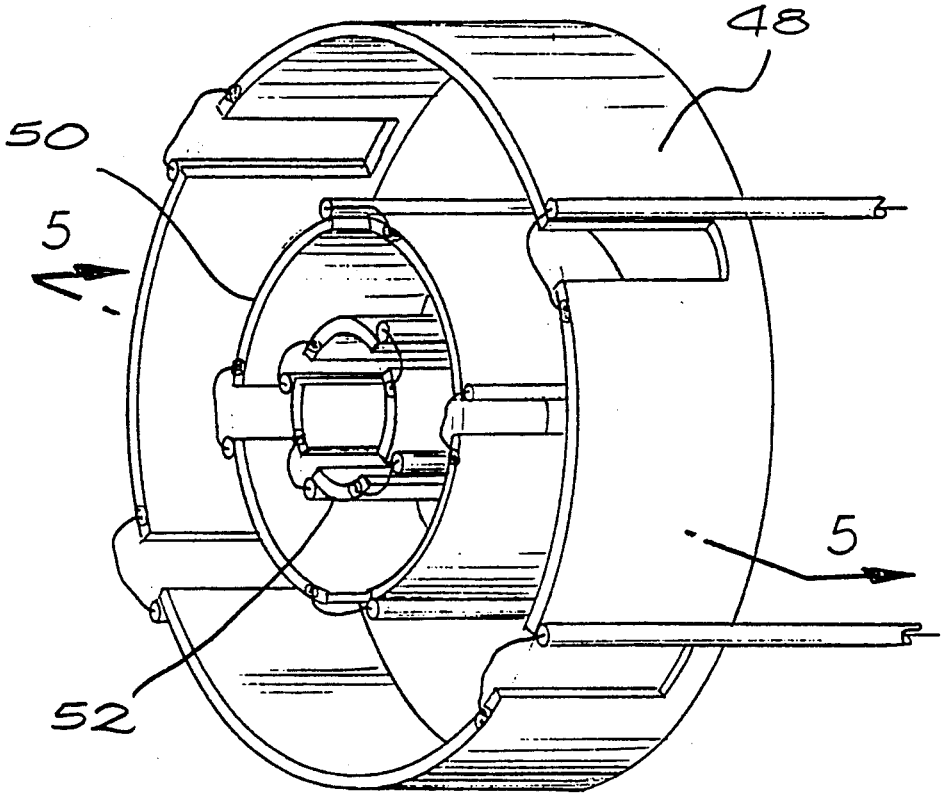
FIG. 3 is a perspective view of an array of concentric, nested antenna elements of FIG. 1 of different sizes to form a multi-frequency band antenna.

Referring now to the drawings with more particularity, wherein like reference numerals designate like or corresponding elements among the several views, in FIG. 1 there is shown an antenna element 10 formed of an electrically conductive material shaped as a cylinder 12 and having an end plate 14 closing one end of the cylinder 12 to form a cavity. The element resembles a cup. Four notches 16, 18, 20 and 22 are formed in the edge of the cylinder at the open end in this embodiment and are used to form four individual notch antennas. The notches 16, 18, 20 and 22 are identical in this embodiment and all are open at the open end of the cup and shorted at the opposite end. The depth 26 of the cavity formed by the closed cylinder will typically be equal to one-fourth of the guide wavelength ($\lambda g/4$) and the depth 28 of the notch will typically be equal to one-fourth of the selected energy wavelength ($\lambda/4$) in the frequency band to be radiated by the antenna element 10. The guide wavelength $\lambda g$ of the cavity is larger than the free space wavelength whereas the wavelength in the notch is very close to the free space wavelength. The circumference of the cylinder will typically be equal to the selected energy wavelength $\lambda$ in the frequency band to be radiated by the antenna element 10.

Each notch 16, 18, 20, and 22 is excited in the embodiment of FIG. 1 by a respective coaxial feed 30, 32, 34 and 36. As shown in FIGS. 1 and 2, the coaxial feed 36 is mounted on the outside of the cylinder at one side of the notch. The coaxial feed could be mounted in other ways, such as inside the cavity which would result in a more compact antenna. However, mounting the coaxial feed on the outside of the cavity will avoid a possible cavity resonant frequency change which may occur if the coaxial feed were mounted inside the cavity. Other feeds such as stripline or microstrip may be used instead of a coaxial feed.

The outer conductor of the coaxial feed may be soldered 38 or otherwise mechanically and electrically connected to the cylinder at one side of the notch and the center conductor attached at the other side of the notch. In FIG. 2, rigid, copper clad coaxial cable is shown with its outer conductor soldered 38 to the cylinder. The center conductor 40 of the coaxial feed 36 is extended to the opposite side of the notch and soldered 42 or otherwise mechanically and electrically connected. While the connection point shown in FIG. 2 is on the edge of the cylinder 12, other connection points may be selected as required for impedance matching purposes.

By means of these electrical connections, edge currents are established in the cylinder rim to form a current loop antenna. The rim currents are shown in dashed lines in FIG. 2 for excited notch 22. The main current flow from the notches follows along the rim of the cylinder just as the current flow of a notch antenna is largely along the edge of the half plane on each side of the open end of the notch. The current flow on the rim of the cylinder is phased properly by the feeds of the notches so that a current loop is formed as discussed previously. Establishing the current flow in the rim results in a current loop antenna with a unidirectional beam pattern, thus an antenna in accordance with the invention does not lose 3 dB in a rear pattern.

By forming the circumference of the antenna element cylinder equal to $\lambda$ and providing four equally spaced notches, a unidirectional loop antenna is established. An appropriate feed network 44 such as Butler or Jones matrices may be coupled to the notches located in four quadrants to properly phase the notches to provide the appropriate modes for monopulse operation in a monopulse application. Also shown in FIG. 1 is a transmit/-receive apparatus 46 for further signal processing. Such feed networks and signal processing apparatus are well known to those skilled in the art and no further detail is provided herein.

More or fewer notches can be provided in the cavity edge depending on the application of the antenna. For example, eight, sixteen or more notches could be formed in the cavity edge. Where fewer than four notches are used however, higher order modes are not available.

Referring now to FIG. 3, an antenna in accordance with the principles of the invention is shown which comprises an array of concentric, nested, notched cylinder elements. Because a plurality of cylinder elements is used which are of differing sizes, a multi-frequency antenna results. Referring to both FIGS. 3 and 4, a set of three cylinder elements 48, 50 and 52 is shown wherein all cylinders are nested concentrically. Each cylinder element has four notches and a feed for each notch. This configuration in accordance with the invention results in the phase centers of all cavities residing on a common aperture plane. Additionally, this phase center is invariant with frequency changes.

Figure 4:
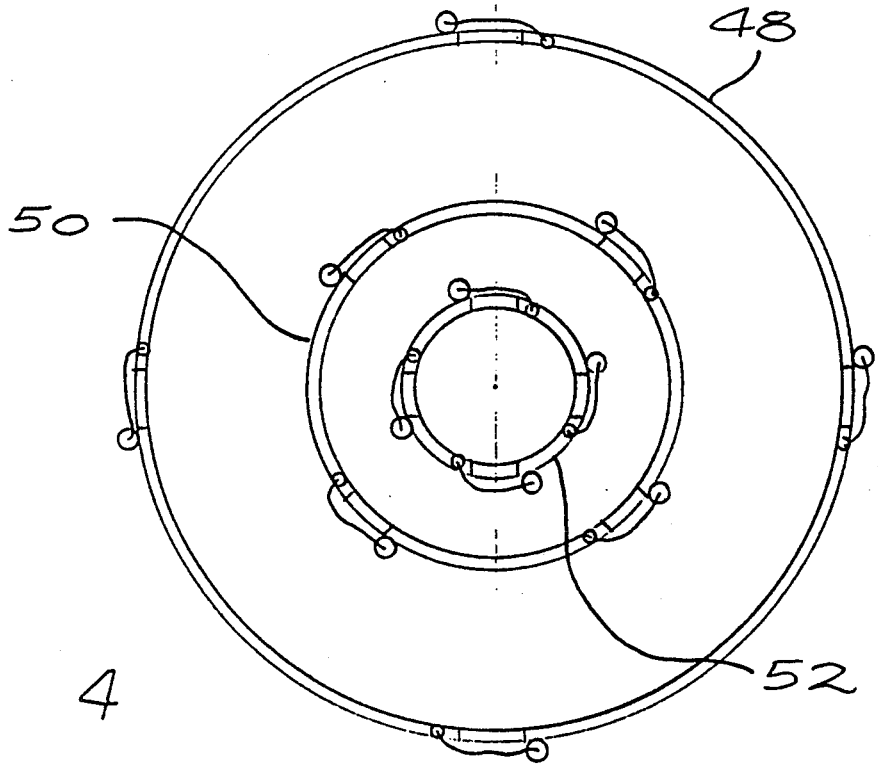
FIG. 4 is a top view of FIG. 3 showing more clearly the concentric nature of the antenna elements and the staggered location of the notches in one embodiment.

In another feature as shown more clearly in FIG. 4, each cavity is rotated in relation to the next cavity so that the notches are staggered or misaligned. In the embodiment shown in FIGS. 3 and 4, the notches are staggered by 45°. This results in better isolation between frequency bands and superior multiplexing performance.

A method of forming the array of nested cavities is presented in FIG. 5. In FIG. 5, the cavities and closed ends are machined from a solid piece of material, such as brass or aluminum. Other techniques may be used to form the cavities such as injection molding or die casting. In the case of relatively small cavities, such as those having a diameter of approximately one inch (2.54 cm), machining may be desirable. For larger cavities, such as those which exceed one foot (30.48 cm) in diameter, brazing, soldering or spot welding may be desirable. For relatively low frequency operation, a wire mesh may be used to form the cavities.

A further advantage of an antenna in accordance with the principles of the invention is that such an antenna is self multiplexing. Self-frequency multiplexing results because each cavity element has its own feeds and separate cavities are used for different frequency bands. Therefore, each frequency band has a separate set of feeds and separate frequency multiplexing is not necessary.

Referring now to FIG. 6, another embodiment of an antenna in accordance with the principles of the invention is shown. A notched antenna element 54 for 20 GHz operation is shown with a 44 GHz open-ended waveguide feed 56 placed in the center. The notched element 54 is used for 20 GHz energy and the notches are dimensioned accordingly. In one embodiment, the notch depth would be equal to $\lambda_{20}/4$. Parasitically excited dipole stubs 58 are placed within the notches to adjust the beam pattern of the antenna element 54. These dipole type stubs 58 may be used to adjust the impedance matching as well as beam pattern adjustment. Because the dipole stubs may penetrate through the notches, they can be of a resonant length without the requirement for top loading.

The currents are shown in FIG. 6 by lines with arrowheads and it can be seen that the 20 GHz dipole current flows along the edge of the 44 GHz waveguide 56. This provides an advantage because the stubs do not block the 44 GHz open-ended waveguide 56 aperture.

In another embodiment, a rod extension (not shown) may be used with the 44 GHz feed 56 aperture and the dipole stubs can be extended out in front of the 20 GHz coaxial aperture to adjust the phase center of the notched antenna element so that it is coincident with that of the dielectric rod of the 44 GHz feed.

Although shown in a cylindrical configuration, the cavity may take other shapes depending upon the application. For example, the cavity may take a square shape in the case where it may be easier to fabricate.

Thus in accordance with the invention, a multi-frequency antenna is provided which is unidirectional and which does not lose 3 dB in a rear pattern absorption arrangement. Additionally, orthogonal circular polarization operation is possible and use in a monopulse application is supported. External frequency multiplexing is not required due to the separate element/separate feed configuration.

Although the term "radiating" is used in the specification and claims, this term is used for convenience only. The structure described herein is meant to be subject to the theory of reciprocity and the term "radiated" meant to also include the function of receiving.

Although preferred and alternative embodiments of the invention have been described and illustrated, the invention is susceptible to numerous modifications and adaptations within the ability of those skilled in the art and without the exercise of inventive faculty. Thus, it should be understood that various changes in form, detail and usage may be made without departing from the spirit and scope of the invention.

What is claimed is:

1. An antenna comprising:

an electrically conductive element forms a cavity, said cavity having an open end, and a closed end, the open end having a perimeter edge, and said cavity having a depth and perimeter edge length selected to radiate a selected frequency band;

a plurality of notches formed in the edge of the cavity at the open end thereof, said notches having a length selected to radiate the selected frequency band; and a plurality of feeds, each one of which is associated with a respective notch and each one of which excites the respective notch at the selected frequency band;

wherein said electrically conductive element further forms:

a plurality of cavities each said cavity having an open end and a closed end, the open end having a perimeter edge, and said cavity having a depth and perimeter edge length selected to radiate a selected frequency band;

a plurality of notches formed in the edge of each cavity at the open end thereof, said notches having a length selected to radiate the selected frequency band; and a plurality of feeds, each one of which is associated with a respective notch and each one of which excites the respective notch at the selected frequency band;

wherein the plurality of cavities are nested with each other.

2. The antenna of claim 1 wherein the cavities are concentrically nested with each other.

3. The antenna of claim 1 wherein the cavities are nested so that the phase centers of all the cavities exist on a common aperture plane.

4. The antenna of claim 3 wherein the cavities are concentrically nested with each other.

5. The antenna of claim 1 wherein each cavity is rotated in relation to an adjacent cavity so that the notches of adjacent cavities are misaligned.

6. The antenna of claim 5 wherein adjacent cavities are rotated so that notches of adjacent cavities are shifted by approximately 45° from each other.

7. The antenna of claim 1 wherein each cavity comprises four notches equally spaced around the respective cavity edge.

8. The antenna of claim 1 wherein each feed comprises a coaxial feed line, a first conductor of which is connected to the respective at one side of the respective notch and a second conductor of which is connected to the respective cavity at the opposite side of the notch from the first conductor.

9. An antenna comprising:

a plurality of cavities concentrically nested with each other so that the phase centers of all of the cavities exist on a common aperture plane, each cavity having an open end and a closed end and an edge at the open end and each having cavity dimensions selected to radiate a different selected frequency band;

a plurality of notches formed in the edge of each cavity at the open end thereof, said notches having lengths selected to radiate the selected frequency band of the respective cavity; and a plurality of coaxial feeds each of which excites a respective notch at the selected frequency band, each of the coaxial feeds is connected to a respective notch in a respective cavity and a first conductor of which is connected to the cavity at one side of the respective notch and a second conductor of which is connected to the cavity at the opposite side of the notch from the first conductor.

10. The antenna of claim 9 wherein each of the cavities is substantially cylindrical in shape.

11. The antenna of claim 9 further comprising a plurality of dipole stubs, each one of which is placed in a respective notch of a selected cavity.

12. A method of radiating energy, comprising the steps of:

forming a plurality of cavities concentrically nested with each other so that the phase centers of all the cavities exist on a common aperture plane, each cavity having an open end and a closed end and an edge at the open end and each having a cavity dimension selected to radiate a different selected frequency band;

forming a plurality of notches in the edge of each cavity at the open end thereof, said notches having lengths selected to radiate the selected frequency band of the respective cavity; and exciting each of the notches at the selected frequency band of the respective cavity.

13. The method of claim 12 wherein the step of forming each cavity comprises forming each cavity in a cylindrical shape.

14. The method of claim 12 wherein the step of exciting each of the notches comprises the steps of:

connecting a first conductor of a coaxial feed to the cavity at one side of the respective notch and connecting a second condutor of the coaxial feed to the cavity at the opposite side of the notch from the first conductor.

15. The method of claim 12 further comprising the step of rotating each cavity in relation to an adjacent cavity so that the notches in adjacent cavities are misaligned.

* * * * *